US007159875B2

(12) United States Patent
Seymour

(10) Patent No.: US 7,159,875 B2
(45) Date of Patent: Jan. 9, 2007

(54) ARTICULATED-SEVERABLE SNOWBOARD ALSO USEABLE AS EMERGENCY SNOWSHOES

(76) Inventor: Keahi Seymour, 2969 26th St., San Francisco, CA (US) 94110

( * ) Notice: Subject to any disclaimer, the term of this patent is extended or adjusted under 35 U.S.C. 154(b) by 226 days.

(21) Appl. No.: 10/719,503

(22) Filed: Nov. 21, 2003

(65) Prior Publication Data

US 2005/0110230 A1 May 26, 2005

(51) Int. Cl.
*B62B 9/04* (2006.01)

(52) U.S. Cl. ..... 280/14.21; 280/817; 280/14.22; 280/14.24; 280/603; 280/608; 280/607; 280/11.18; 280/22; 280/16; 280/17; 280/21.1; 280/28.16; 280/28.11; 280/20

(58) Field of Classification Search ..... 280/603, 280/608, 607, 11.18, 817, 818, 14.21, 14.22, 280/14.24, 28.16, 20
See application file for complete search history.

(56) References Cited

U.S. PATENT DOCUMENTS 5,884,933 A * 3/1999 Trott ..... 280/603
6,270,091 B1 * 8/2001 Smith ..... 280/14.21
6,616,170 B1 * 9/2003 Quarti ..... 280/603

* cited by examiner

*Primary Examiner*—Christopher P. Ellis
*Assistant Examiner*—Cynthia F. Collado
(74) *Attorney, Agent, or Firm*—Davis & Bujold, P.L.L.C.

(57) ABSTRACT

An articulated snowboard includes first and second members that are joined at a first end by an articulation mechanism that permits vertical offset between the members while preserving parallel orientation of at least one of a longitudinal axis through each member and a leading edge of each member. Articulation enhances stability, user control, and braking action. Further, the articulation mechanism permits folding the articulated snowboard in half for storage and transport, and also permits separating the two members. When separated the two members can be worn by a user as emergency snowshoes or short skis.

26 Claims, 4 Drawing Sheets

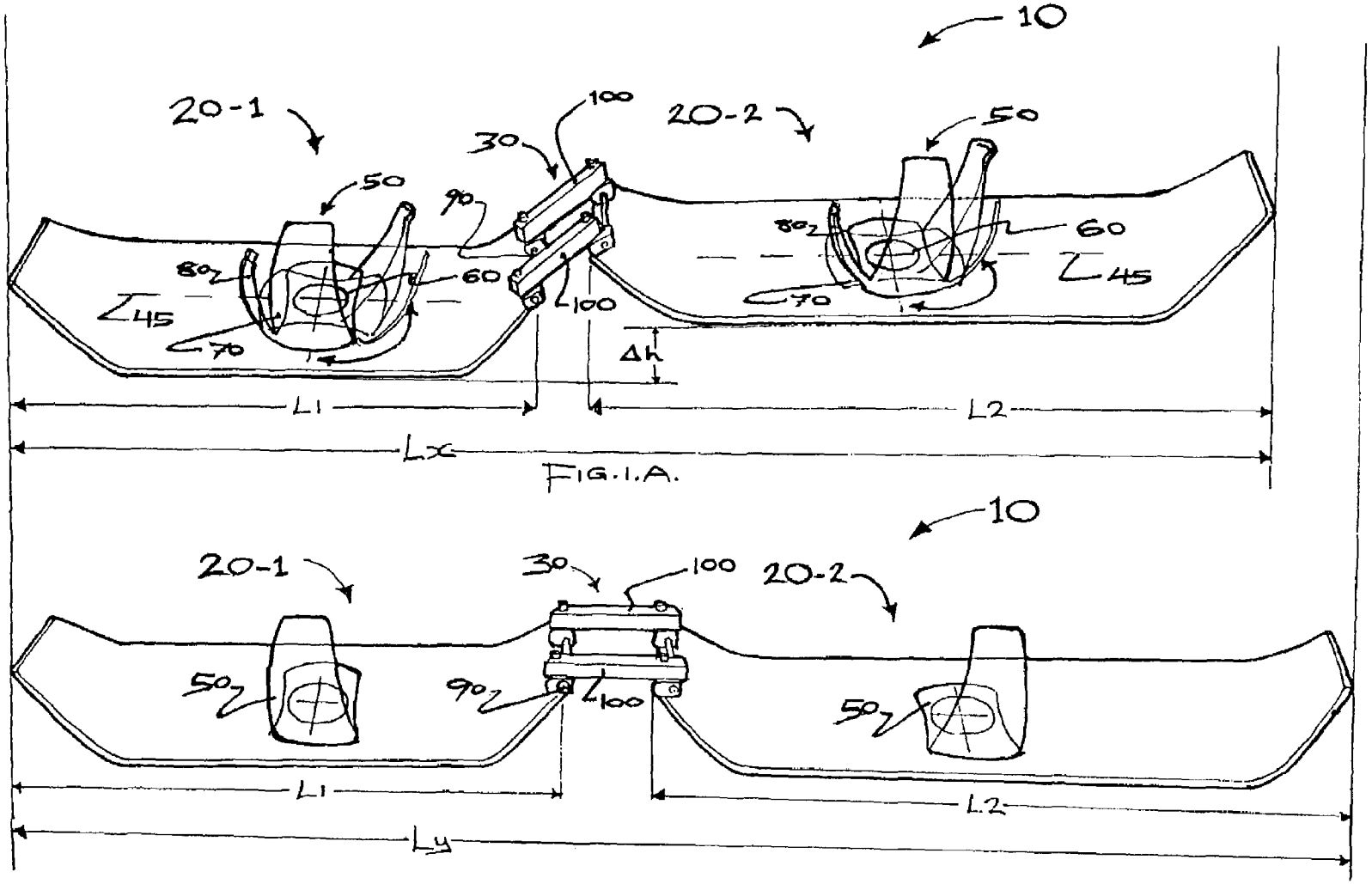
FIG. 1.A.
FIG. 1.B.

ARTICULATED-SEVERABLE SNOWBOARD ALSO USEABLE AS EMERGENCY SNOWSHOES

FIELD OF THE INVENTION

The present invention relates generally to snowboards, and more particularly to providing an articulated snowboard that can be separated to serve as a pair of emergency snowshoes.

BACKGROUND OF THE INVENTION

Snowboards are known in the art. Conventionally a snowboard comprises a single substantially planar member to which a user's two feet can be mounted such that the user stands sideways to the direction of snowboard travel. Unfortunately such snowboards are rather cumbersome to carry about, being perhaps 5' in length and too long to pack in many conventional rucksacks. When attempting to turn on a conventional snowboard, the user typically carves into the snow with the downward edge of the snowboard. A typical turning radius for a conventional snowboard is perhaps 15 m, whereas a substantially smaller turning radius would be desirable. While carving with a conventional snowboard results in a turn, the user's speed is substantially reduced, due to the necessity of the carving action. This can be very disadvantageous to the user, especially where a turn must be made on a somewhat flat region of snow. Typically the user loses so much speed in negotiating the turn, that one foot must be taken off the snowboard and used to propel the snowboard, somewhat scoot-fashion, along the flat surface. Further, conventional one-piece rigid snowboards tend to be long (perhaps over 6') for fast downhill travel, and tend to be short (perhaps 4' or less) for better maneuverability and for performing tricks. This means a snowboard user must own several snowboards if it is desired to engage in these different snowboarding activities. Understandably it would be advantageous if a single snowboard could somehow better accommodate these different snowboarding activities. Further conventional snowboards are unstable over uneven terrain or when atop obstacles as surface with the terrain is varied, and tend to be unforgiving should the user make an error when attempting to navigate over such terrain. In addition, conventional snowboards are rather unforgiving and stressful to the user's feet and ankles, which are essentially locked into a rigid position on the snowboard.

U.S. Pat. No. 6,053,513 to Dickinson (2000) discloses a snowboard comprising first and second overlapping members that are pivoted together such that the members are coplanar but can move relative to each other like the hands on a clock. U.S. Pat No. 6,270,091 to Smith (2001) discloses an articulated two-piece snowboard in which each member has a plurality of downwardly extending ridges that apparently are intended to maintain the snowboard in a straight line of travel. It appears, however, that the leading edges of the two members in Smith '091 need not remain parallel to each other, although the two members appear to be constrained to be coplanar. Further, an imaginary longitudinal axis extending the length of each of the two members is also not maintained parallel in Smith '091. U.S. Pat. No. 5,799,956 to Shannon (1998) discloses an articulated snowboard in which neither the leading edges nor the longitudinal axes of the articulated members are constrained to remain parallel to each other. Planes defined by the two members appear to be coplanar. None of these patents, however, disclose separating and using the two members as emergency snowshoes.

Regardless of how the snowboard is fabricated, it is all too common for the user to sometimes become lost while snowboarding, or become stranded in a relatively flat snow area. It can be extremely fatiguing for the user to try to "scooter" out of the flat area using the snowboard. On the other hand, it can be impossible to move out of the area if the user's two feet are taken off the snowboard.

What is needed is an articulated snowboard that permits a user to negotiate curves without having to use the lower edge(s) of the snowboard to carve into the snow, thus maintaining more of the user's speed. Articulation should be such that at least the longitudinal axis of each of the joined members remain substantially parallel, if not also the leading edge of each of the members. Preferably such articulated snowboard can be separated into two portions that can be used as emergency snowshoes by the user, for example to move out of flat region of snow. Preferably such an articulated snowboard should also be useable as a dirt board and/or skateboard or vehicle using snowboard stance.

The present invention provides such an articulated snowboard.

SUMMARY OF THE INVENTION

The present invention provides an articulated but preferably sever able snowboard that may be used as an emergency pair of snowshoes. The snowboard comprises first and second members that are articulatable joined such that preferably the longitudinal axis of each member, and possible also the leading edge of each member, remain substantially parallel in use. The joining is such that one member may be lifted perhaps 0" to 12" relative to the other member, for example while negotiation a snow mogul. Each member may be said to defined a plane, but the plane of the first member need not be coplanar with the plane of the second member. Articulation permits a user to negotiate curves without having to carve into the snow with the leading edge(s) of the snowboard. Instead, the user can keep both members of the snowboard substantially planar and simply turn into the curve, without losing speed. Further, the articulated snowboard can be folded about the articulation member, to promote portability and storage. Preferably the two members can be separated from each other, and the bindings rotated 90° and moved linearly along central axis 45 such that in an emergency, the user can wear the two members as snowshoes.

Other features and advantages of the invention will appear from the following description in which the preferred embodiments have been set forth in detail, in conjunction with their accompanying drawings.

BRIEF DESCRIPTION OF THE DRAWINGS

FIG. 1A depicts an articulated snowboard with the first snowboard member elevated with respect to the second snowboard member, according to the present invention;

FIG. 1B depicts an articulated snowboard with the first and second snowboard members on a common plane, according to the present invention;

DETAILED DESCRIPTION OF THE PREFERRED EMBODIMENT

Figure 2A:
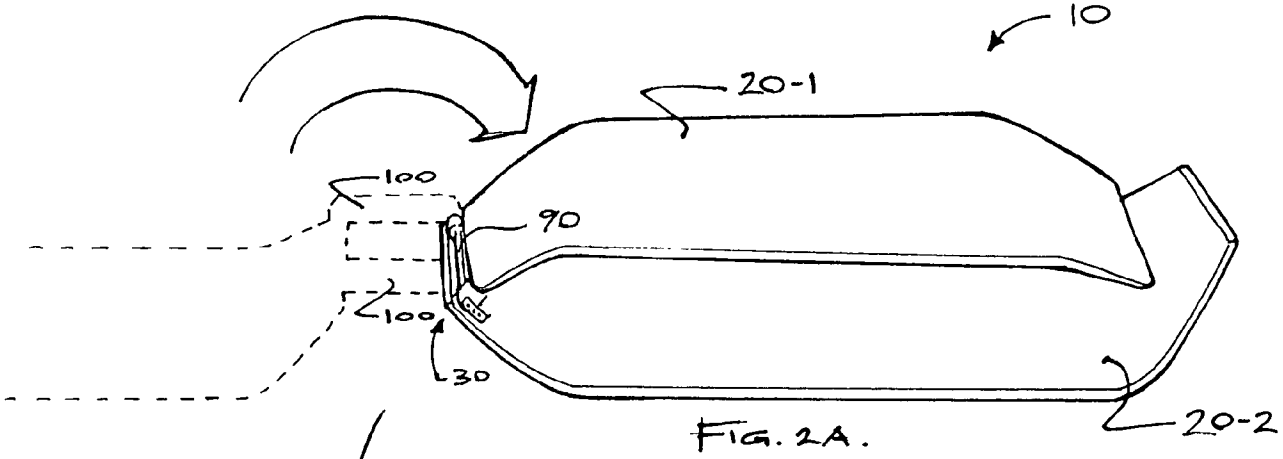
FIG. 2A depicts an articulated snowboard in a folded-over configuration, according to the present invention.

FIG. 1A depicts an articulated snowboard 10 as comprising substantially similar first and second snowboard members 20-1, 20-2, joined together at one end of each member by an articulation mechanism 30. Articulation mechanism 30 joins members 20-1 and 20-2 such that a plane of one member can displace a vertical offset distance Δh of about 0" (e.g., no offset) to about 12" , and more preferably perhaps about 5" to about 8" relative to a plane of the other member, yet at all times the leading edge 40-1 of first member 20-1 remains parallel to leading edge 40-2 of second member 20-2. By leading edge it is meant the edge of each member that faces in the direction a user of articulated snowboard 10 is facing during normal use. Generally the leading edges will be facing in a downhill direction, and typically will be parallel to a longitudinal axis 45 of the associated member 20-1, 20-2. Note too that in the configuration shown, the longitudinal axes 45 through each member 20-1, 20-2 also remain substantially parallel. The preferably permissible vertical offset of about 5" to 8" permits the user to easily navigate moguls in downhill snowboarding. It is understood that either of member 20-1 and 20-2 may be higher or lower than the other member by up to about 12" and more typically about 8" . While one might use the present invention even if members 20-1 and 20-2 were not joined to one another, such operation would result in greater stress and fatigue to the user's knees and ankles.

Length L1 of member 20-1 and length L2 of member 20-2 will each be perhaps 2.5' to 3' . However articulated coupling between members 20-1 and 20-2 can result in a user-varied effective length as short as Lx (in FIG. 1A) and as long as Ly (in FIG. 1B). The differential between Lx and Ly is perhaps about 4" to about 8" , and permits a user to dynamically alter the snowboard characteristics by varying the effective length from Lx to Ly during actual use. For example, a greater effective length Ly is desired for speed, whereas a shorted effective length Lx is desired for maneuverability, tricks, and control.

The left-to-right edge width of each member will typically be on the range of about 6" to 12" , and the top-to-bottom thickness of each member will depend upon the materials used during fabrication, but will be on the order of perhaps 0.25". It is understood that these dimensions are exemplary and other dimensions could be used. Members 20-1, 20-2 will preferably be fabricated from a durable material, especially durable on the lower, snow-facing surface. Members 20-1, 20-2 may be cast from a durable plastic, or may be fabricated from laminations of material, including metal. Applicant believes that the material strength requirement imposed upon each member of an articulated snowboard will be less than the overall material strength requirements dictated by a conventional rigid one-piece snowboard. As a result, a savings in production costs and overall weight can be achieved for the present invention.

Figures 4A, 4B, 4C:
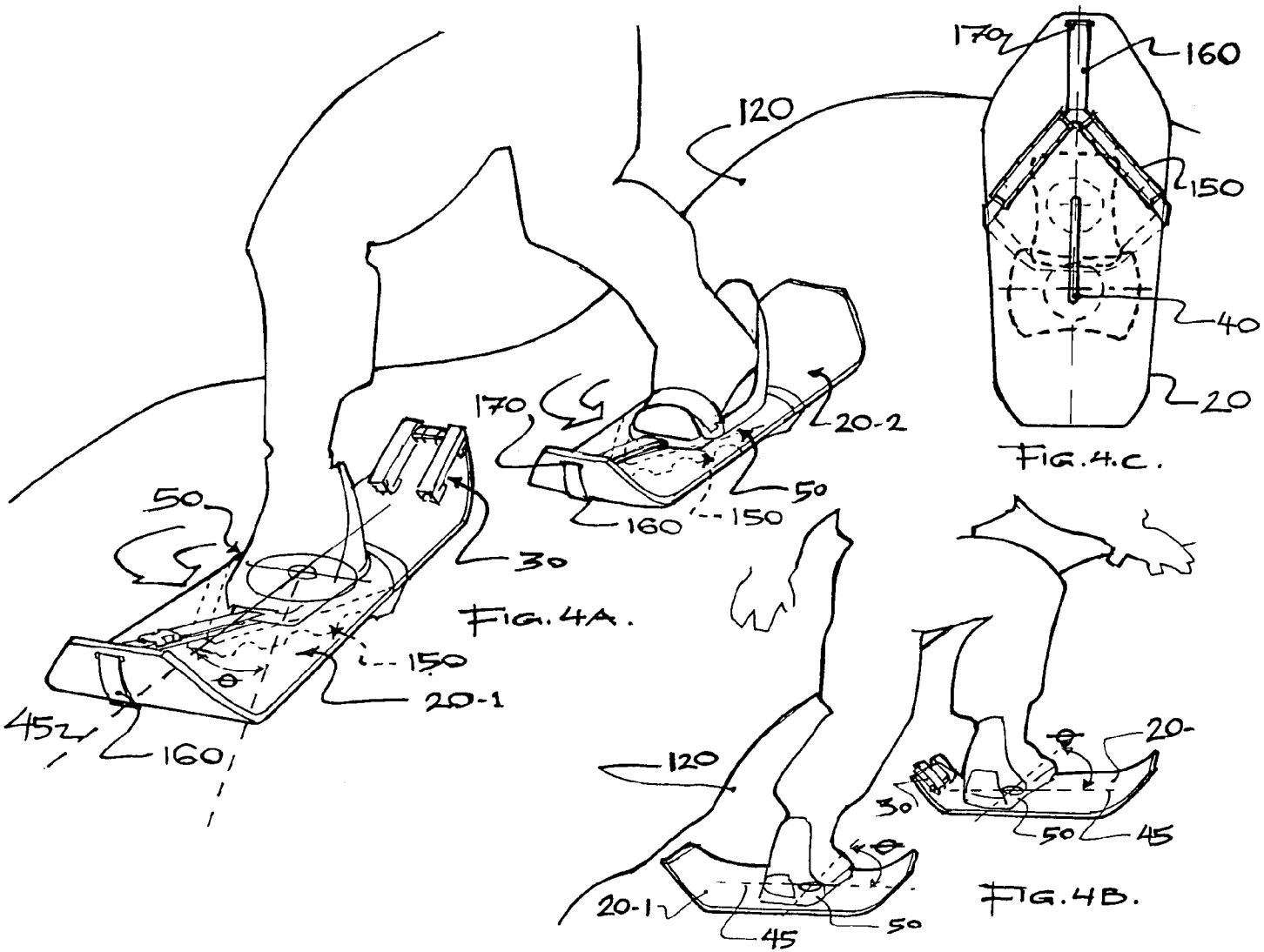
FIGS. 4A-*and* 4B depict a user using separated members of an articulated snowboard as snowshoes or short skis, according to the present invention.
FIG. 4C is a bottom view of one separated snowboard member showing attachment of an optional cleat and binding slide showing snowboard and snowshoe binding placement according to the present invention.

Each member 20-1, 20-2 will include a binding mechanism 50 by which a user's foot or boot can be attached to an upper surface of the member. Preferably binding mechanism 50 includes a rotatable member 60 to which is attached a heel stop 70 and binding straps 80 or the like. Member 60 is preferably rotatable and linearly sliding to allow the present invention to be used as emergency snowshoes, as shown in FIGS. 4A and 4B. In such snowshoe mode, articulation mechanism 30 permits articulated snowboard 10 to be readily separated such that members 20-1 and 20-2 are not coupled to each other, and rotation and sliding of member 60 gives the user great leeway in using the present invention as snowshoes.

While FIG. 1A depicts articulated snowboard 10 with a vertical offset, present perhaps while the user snowboards downhill over a mogul, FIG. 1B depicts snowboard 10 with members 20-1 and 20-2 on a common plane, without vertical offset. As indicated by shown in FIGS. 2A and 2B, an additional advantage of the present invention is that it can be folded essentially in half to provide a relatively compact package for purposes of carrying and transporting, e.g., a 2.5' to 3' long package as contrasted with a 5' to 6' long package for a unitarily constructed prior art snowboard.

Articulation mechanism 30 may be implemented in a variety of ways. Referring to FIGS. 1A, 1B, 2A, and 2B, mechanism 30 will preferably include one pivot rod 90 fixedly attached to the joining end of member 20-1 and member 20-2, with pivot rod 90 typically disposed at right angles to the longitudinal axis 45 of the associated member. At least one link arm 100 is pivotally attached to rotate about pivot rod 90 attached to each joined end of a member 20-1 and 20-2. As noted, articulation of unit 30 is such that the joined-together ends of member 20-1 and 20-2 can be offset a variable distance ranging from zero (e.g., snowboarding on level terrain) to about ±12", and more preferably about ±8". Stress bearing components of articulation unit 50 should be made of durable material, for example metal, high strength non-brittle plastic, etc.

The movement of the articulation and or board segments could be connected to a suspension/dampening system to give enhanced performance, safety and protect damage to the user leg joints/tendons.

Figure 2B:
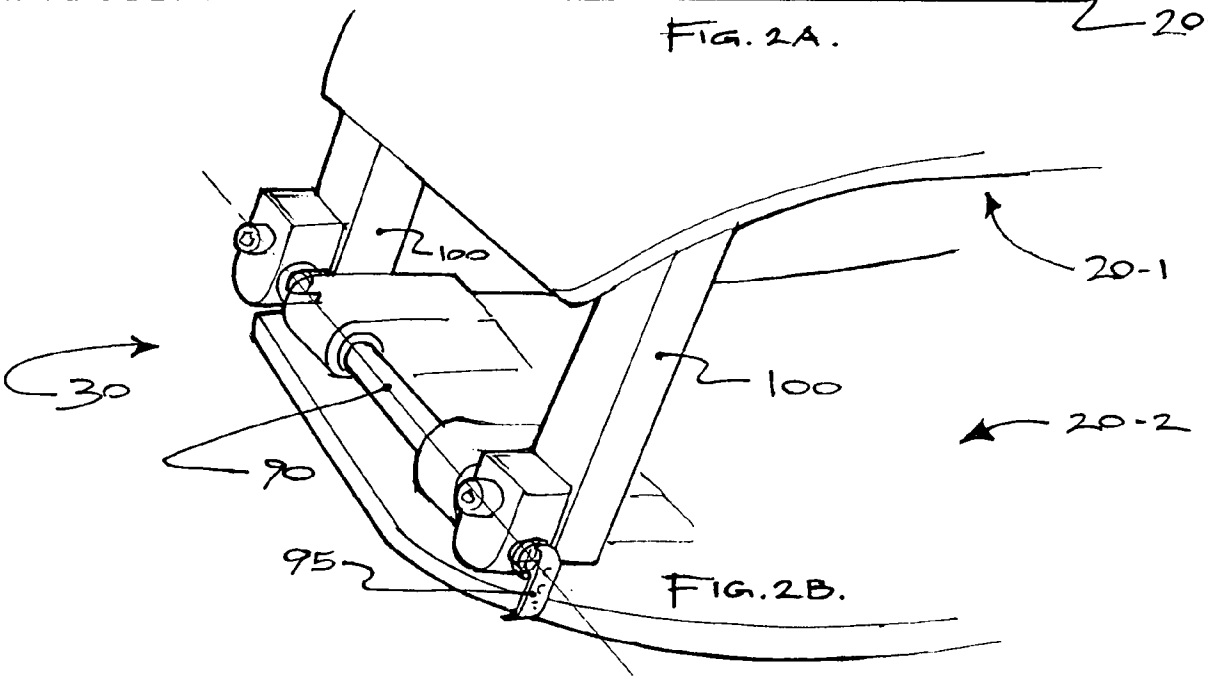
FIG. 2B is a detailed view of the articulation unit of the folded-over articulated snowboard of FIG. 2A, according to the present invention.

As best shown in FIGS. 2A and 2B, the joining action provided by articulation unit 50 readily permits members 20-1 and 20-2 to be folded over, as indicated by the curved arrow in FIG. 2A, for storage and for transporting. As noted, the overall length of articulated snowboard 10 in a folded-over configuration can be under about 3'. As shown in FIG. 2B, a quick-release type mechanism 95 can be provided to allow a user to rapidly separate snowboard 10 into two separated members 20-1, 20-2, e.g., for use a emergency snowshoes.

It will be appreciated that including a quick-release mechanism 95 enables a snowboarder to carry (e.g., in a backpack worn during use) an extra one of member 20-1 and 20-2, which extra member could be of substantially different length L1 or L2. As such at the top of a long slope, the user might wish to detach a shorter version of member 20-2 and instead now attached a longer version, to gain greater downhill speed. The longer version might be 12" longer, for example, although shorter or longer substitute version(s) could be used.

Figure 3:
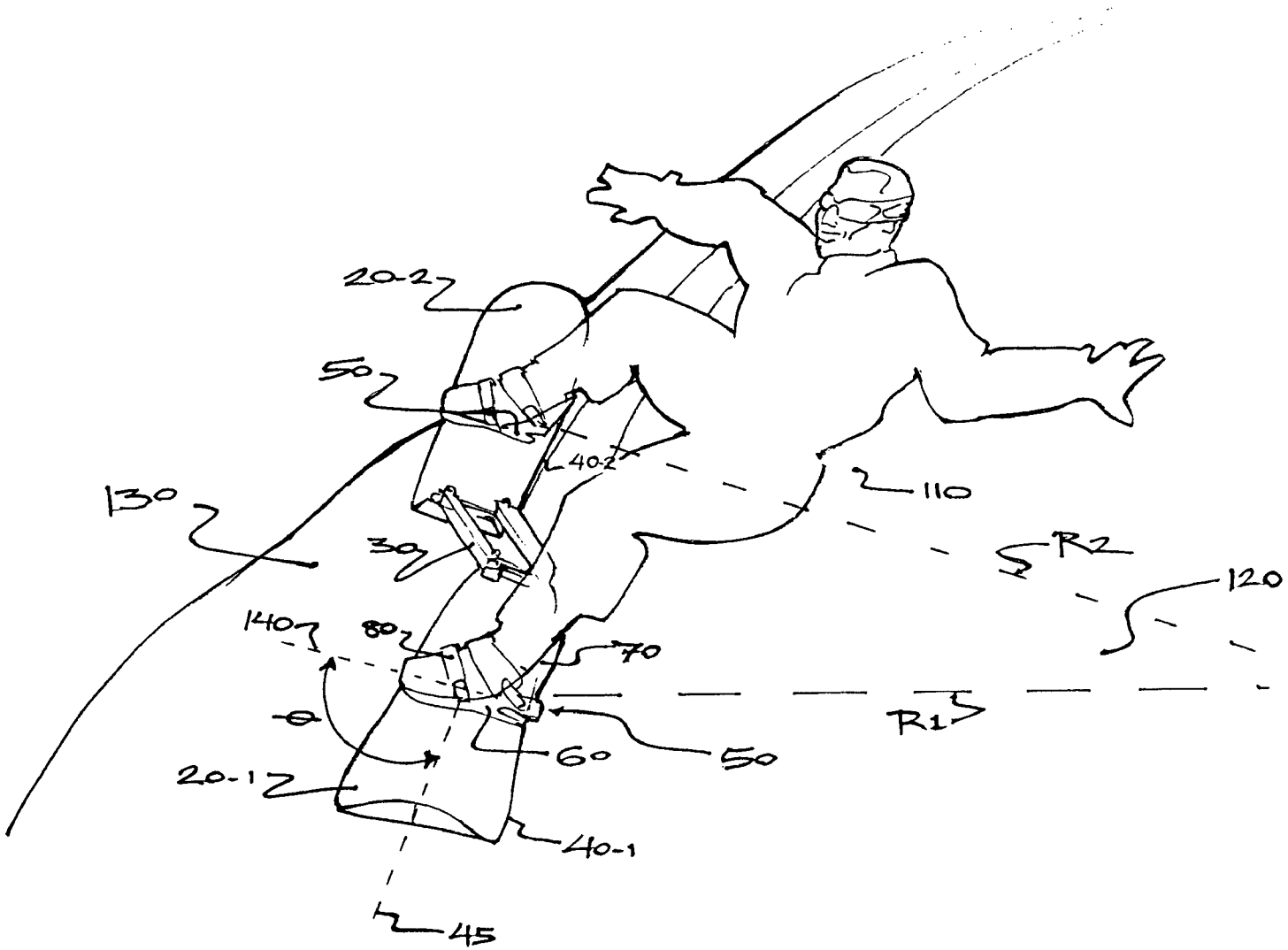
FIG. 3 depicts a user riding an articulated snowboard, according to the present invention.

FIG. 3 depicts a user 110 snowboarding with articulated snowboard 10 down a terrain 120 and moving slightly to the user's left. Front member 20-1 is shown higher elevation than the rear member 20-2, as a mogul 130 is being traversed. Note, however, that the front edges 40-1, 40-2 of members 20-1, 20-2 remain substantially parallel to each other during the snowboarding action. The articulation provided by the present invention enables the user to more rapidly traverse terrain 120. For example, the user can maintain a high downhill velocity while turning, simply by pushing the rear member, 20-2, outward relative to the front member 20-1. Good speed, excellent maneuverability, shorter turning radii, and stability are maintained. By contrast, if a unitary construction snowboard were being used, the user would have to carve the front edge of the snowboard into the snow during the turn, thus losing downhill speed. (By "carve" it is meant that the plane of the snowboard would no longer remain essentially parallel to the plane of the snow, but rather would be tilted such that the front edge of the snowboard digs into the snow and the opposite edge is somewhat elevated from the snow.) But in addition to maintaining good downhill speed while turning, the turning radius provided by the present invention is substantially smaller than the turning radius of a convention, rigid, snowboard, e.g., about 50% smaller. Thus in practice, a turning radius of about 7 m can be realized with the present invention, as contrasted with about 15 m for a rigid snowboard of the same overall, front-to-back, length L. In FIG. 3, the turning radius of the front member is shown as R1, and the turning radius of the rear member is shown as R2, wherein at the moment R2 is slightly greater than R1 due to the user's positioning of the two members.

Conventional carving is done using the whole edge of the board or both board segment edges that lean in the snow. Two pivots mounted along the central axis would also allow each segment to independently carve allowing which or the amount of board edge used to carve to be regulated and therefore give greater control over the board during turns and increased speed due to less carving surface area utilized for each turn.

Further, the user has better control over the articulated snowboard, even while negotiating a turn at higher speed and with substantially shorter turning radius than an equivalent length prior art rigid snowboard.

A user can also control snowboard 10 in a turn by moving the front region of rear member 20-2 close to if not almost overlapping the rear region of front member 20-1, and offsetting the longitudinal axis somewhat so the leading edge of the rear member is closer to the longitudinal axis of the front member. The result, unobtainable with a prior art snowboard, is an effective shortening of the overall length L of the articulated snowboard, and a smaller turning radius for the front member than for the rear member, e.g., R1 versus R2 in FIG. 3. This differential in turning radii can exert a desired turning action with slight retarding of speed, but since the turn can be completed much more rapidly, the user can then "straighten-out" the two members and recoup the downhill speed. Further, this ability to dynamically effectively lengthen or shorten the overall length L of the articulated snowboard permits the user to vary the snowboard characteristics to the terrain immediately encountered. Thus if great speed is desired, the effective length L is increased by moving the front portion of the rear member as far away as possible from the rear portion of the front member. However if maneuverability is suddenly required, e.g., in a turn, the effective length L can be decreased, as noted above. Such flexibility is provided by a single articulated snowboard, as contrasted with a user having multiple prior art snowboards of varying lengths.

Also, the force exerted by the user's foot on each of the two members can be varied to further control the present invention. For example, while going downhill, the user might actually elevate much of the front member up and away from the terrain, essentially snowboarding only on the rear member. This enables the user to increase speed in a very short distance.

For increased mobility perhaps for beginners a central directional ski attached to the articulation mechanism could be added. This would allow the user to steer easier without the need to carve( i.e. better slow speed turning.). When moving board segments to opposite directions to turn when carving the central ski points to the direction of the turn providing steering.

Note too that if the user must suddenly slow his forward motion, the present invention permits using the rear or uphill member, here member 20-2, as a drag rudder. Thus in FIG. 3, if the user pushes down hard with his right foot, rear member 20-2 will increase drag, thus slowing forward motion and providing a safe braking action. This drag rudder aspect is the opposite of the speed increase achieved by elevating the front member of the articulated snowboard, described above. Drag rudder braking and the above described associated enhanced maneuverability is not readily available with a unitary construction prior art snowboard. It will be appreciated that the drag rudder aspect of the invention is present even if the vertical offset distance is constrained to be about 0". Thus in general, the present invention can provide a safe snowboarding experience that is especially amendable to newcomers. The enhanced stability and control that is provided by an articulated snowboard encourages newcomers to try the hobby and to more rapidly progress from being novices to more expert snowboarders.

As noted, preferably binding mechanism 50 is pivotable. Thus in FIG. 3, pivot mechanism 50 is preferably locked such that a longitudinal axis 140 of the user's feet or boots is perhaps orthogonal to (but not parallel to) the longitudinal axis 45 of the individual members 20-1, 20-2. Binding mechanism 50 can, if desired, include an arc of detents enabling the user the lock the mechanism at a desired angle ° close to perhaps 90° for normal snowboarding. The binding mechanism 50 also slides along central axis 45 for optimum foot position for both disciplines.

It is not uncommon for snowboarders to end up off of defined snowboard areas, perhaps ending up on a flat terrain, substantially far from the next downhill region. In the prior art, the snowboarder must either remove the snowboard and try to walk out in what may be deep snow, or use the unitarily constructed snowboard as a scooter. In either case, the going is slow and extremely fatiguing. If the snowboarder cannot get back to a downhill area within a reasonable time period, the very safety of the user may be jeopardized due to cold temperatures.

As best seen in FIGS. 4A and 4B, the present invention enables a user to rapidly separate articulated snowboard 10 into separate members 20-1 and 20-2, for example by removing one of the pivot members 90. (If desired, a short cable could be permanently affixed to the removable pivot member to connect the pivot member to the associated member 20-1 or 20-2, to guard against loss.)

In FIG. 4A, the user has separated the snowboard into separate members 20-1 and 20-2 and has rotated binding mechanism 50 to define an angle ° that may be close to 0°. and the foot position has been moved along the central axis of the board segments. To improve safety in emergency conditions a quick release latch(s) would be used to operate all functions for conversion between modes without removing your feet from the bindings, providing a safe and easy transition to both operating modes. In this configuration, the user's feet face forward, and the two members 20-1, 20-2 can be used as short skis or as snowshoes. (If desired the user might carry fur linings to be placed on the undersurface of member 20-1, and 20-2, such as the linings used on cross-country skis to permit low friction movement forward, but high friction movement rearward.) Also shown in FIG. 4A and in bottom view 4C is an optional cleat 150, removably attached to the bottom surface of each snowshoe member 20-1, 20-2, to provide good traction when using the invention as emergency snowshoes. Cleat 150 is shown attached to member 20-1 using a strap 160 that passes through a slot 170 in the snowshoe member and is attachable to an upper region of the snowshoe or to a portion of binding mechanism 50. Cleat 150 will typically be made of a durable material, e.g., aluminum, steel, etc., while strap 160 may be a flexible material such as nylon. Understandably cleat(s) 150 may be attached in other ways, for example by means of a thumb-screw, a releasable latch, etc.

FIG. 4*c* shows binding movement along center axis 45 on a slide rail 40 and moving 90° from snowboard to snowshoe placement.

In the configuration shown in FIG. 4B, the user must move uphill, and is shown doing so with bindings 50 locked in a position enabling the user's boots to be substantially orthogonal to the longitudinal axis 45 of each of members 20-1, 20-2, e.g.,°. 90°.

In FIGS. 4A and 4B it is understood that once the user reaches terrain more amenable to snowboarding, members 20-1 and 20-2 will be rejoined to one another with mechanism 30, whereupon the user can more rapidly maneuver across the terrain.

A locking mechanism could be attached to members (100) to inhibit the articulation and hence allow the device to be used as a conventional snowboard and also allow the board pieces to remain rigid for use on chairlifts and adhere to ski park regulations.

To summarize, the present invention provides an articulated snowboard that can have a form factor during storage and carrying that is about half the length of a conventional unitarily constructed snowboard. Articulation enables the present invention to exhibit increased maneuverability, stability, and to maintain greater downhill speed, especially during turns, which turns can be accomplished with reduced turning radii. Articulation preferably constrains at least one of the longitudinal axis and leading edge of each member of the articulated snowboard to remain substantially parallel, respectively, to the corresponding one of longitudinal axis and leading edge of the other member. Safety is enhanced not only because of the improved maneuverability, but due to the ability to use the uphill snowboard member as a drag rudder. Further, should the snowboarder become stranded in flat terrain, the two members comprising the articulated snowboard can be separated to allow use as emergency snowshoes or short skis. If desired, an articulated device such as described herein could be fabricated for use over surfaces other than snow, dirt, water, (e.g., an articulated surfboard) for example. Further, if desired, a small motor could be attached to the rear-most member to provide a power-ride on an articulated device, according to the present invention.

Modifications and variations may be made to the disclosed embodiments without departing from the subject and spirit of the invention as defined by the following claims.

What is claimed is:

1. An articulated snowboard comprising: a first member; a second member; and an articulation mechanism defining a dynamic range of motion pivotally joining a first end of said first member to a first end of said second member;

wherein said articulation mechanism joins said first member and said second member such that at least one of a lateral edge and a longitudinal axis of said first member remains substantially parallel to a corresponding one of a lateral edge and a longitudinal axis of said second member throughout the dynamic range of motion of the articulation mechanism.

2. The articulated snowboard of claim 1, further comprising:

means for removably attaching a user's boot to said first member; and means for removable attaching a users boot to said second member.

3. The articulated snowboard of claim 1, wherein said articulation mechanism joins said first member and said second member such that said first end of said first member can offset vertically a distance Dh greater than 1" from said first end of said second member.

4. The articulated snowboard of claim 1, wherein said articulation mechanism joins said first member and said second member such that said first end of said first member can offset vertically a distance Dh up to about 12" from said first end of said second member.

5. The articulated snowboard of claim 1, wherein said articulation mechanism joins said first member and said second member such that an overall length of said articulated snowboard is dynamically variable by a user of said snowboard.

6. The articulated snowboard of claim 1, wherein said articulation mechanism joins said first member and said second member such that an overall length of said articulated snowboard is dynamically variable by a user of said snowboard within a range of about ±5".

7. The articulated snowboard of claim 1, wherein said articulation mechanism joins said first member and said second member such that at least one of a lateral edge and a longitudinal axis of said first member remains substantially parallel to a corresponding one of a lateral edge and a longitudinal axis of said second member, while permitting said first end of said first member to offset vertically a distance Dh in a range of about −8" to about +8" from said first end of said second member.

8. The articulated snowboard of claim 1, wherein said articulation mechanism joins said first member and said second member such that said second member can be urged downward by a user to act as a drag rudder to slow movement of said articulated snowboard.

9. The articulated snowboard of claim 1, wherein said articulation mechanism locks which rigidly joins both board segments to form a conventional snowboard.

10. The articulated snowboard claim 1, wherein said articulation mechanism attaches to a central directional ski to increase maneuverability.

11. The articulated snowboard claim 1, wherein said articulation member is linked to suspension/dampening to increase performance.

12. The articulated snowboard of claim 1 wherein said articulation mechanism allows pivoting along the longitudinal axis of both segments giving each board segment the ability to carve independently.

13. The articulated snowboard of claim 1, wherein said articulation mechanism permits separating said first member from said second member, whereupon said first member and said second member can be used as one of snowshoes and short skis.

14. The articulated snowboard of claim 1, wherein said articulation member permits folding said first member substantially atop said second member when said articulated snowboard is not in use.

15. The articulated snowboard of claim 1, further comprising:

means for removably attaching a user's boot to said first member; and means for removable attaching a user's boot to said second member; wherein each said means for removably attaching is user-rotatable relative to a longitudinal axis of said first member and said second member; wherein said articulation mechanism permits separating said first member from said second member, whereupon said first member and said second member can be used as one of snowshoes and short skis.

16. A method of manufacturing an articulated snowboard, the method comprising the following steps:

providing a first member and a second member; and pivotally joining a first end of said first member to a first end of said second member with an articulation mechanism defining a dynamic range of motion; and joining said first member and said second member and maintaining at least one of a lateral edge and a longitudinal axis of said first member substantially parallel to a corresponding one of a lateral edges and a longitudinal axis of said second member throughout the dynamic range of motion of the articulation mechanism.

17. The method of claim 16, further comprising:

providing on an upper surface of said first member and said second member a mechanism to removably attach a users boot to said upper surface.

18. The method of claim 16, wherein pivotally joining includes joining said first member and said second member such that said first end of said first member can offset vertically a distance Dh greater than 1" from said first end of said second member.

19. The method of claim 16, wherein pivotally joining includes joining said first member and said second member such that said first end of said first member can offset vertically a distance Dh up to about 8" from said first end of said second member.

20. The method of claim 16, wherein pivotally joining including joining said first member and said second member such that an effective overall length of said articulated snowboard is dynamically variable by a user of said snowboard.

21. The method of claim 16,wherein pivotally joining including joining said first member and said second member such that an effective overall length of said articulated snowboard is dynamically variable by a user of said snowboard within a range of about ±5".

22. The method of claim 16, wherein pivotally joining includes joining said first member and said second member such that said second member can be urged downward by a user to act as a drag rudder to slow movement of said articulated snowboard.

23. The method of claim 16, wherein pivotally joining includes removably pivotally joining such that said first member can be separated from said second member, whereupon said first member and said second member can be used as one of snowshoes and short skis.

24. The method of claim 16, wherein pivotally joining includes joining such that said first member can be folded substantially atop said second member when said articulated snowboard is not in use.

25. A method of snowboarding using an articulated snowboard having a first member articulatably joined at a first end to a first end of a second member, the method comprising the following steps:

attaching a user's left boot to said first member and attaching a user's right boot to said second member; and maintaining a longitudinal axis of said first member substantially parallel to a longitudinal axis of said second member throughout a complete dynamic range of motion between the first member and the second member, while permitting said first end of said first member to move vertically relative to said first end of said second member.

26. The method of claim 16, wherein an effective length of said articulated snowboard is dynamically varied by said user while using said snowboard.

* * * * *